US006568458B2

(12) United States Patent
Naik et al.

(10) Patent No.: US 6,568,458 B2
(45) Date of Patent: May 27, 2003

(54) REINFORCED CERAMIC SHELL MOLD AND METHOD OF MAKING SAME

(75) Inventors: Rajeev V. Naik, Yorktown, VA (US); John Corrigan, Yorktown, VA (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 10/022,470

(22) Filed: Oct. 30, 2001

(65) Prior Publication Data

US 2002/0134526 A1 Sep. 26, 2002

Related U.S. Application Data

(62) Division of application No. 08/935,846, filed on Sep. 23, 1997, now Pat. No. 6,364,000.

(51) Int. Cl.[7] ..... B22C 9/04

(52) U.S. Cl. ..... 164/361; 164/519; 164/411

(58) Field of Search ..... 164/516, 517, 164/518, 519, 34, 35, 122.1, 122.2, 361, 411

(56) References Cited

U.S. PATENT DOCUMENTS

| | | | | |
|---|---|---|---|---|
| 3,032,842 A | | 5/1962 | House | 164/516 |
| 3,066,365 A | | 12/1962 | Moore | |
| 3,508,602 A | | 4/1970 | Mellen et al. | |
| 3,654,984 A | | 4/1972 | Mellen et al. | |
| 3,898,313 A | | 8/1975 | Taylor | 264/225 |
| 4,492,265 A | | 1/1985 | Donomoto et al. | |
| 4,851,057 A | * | 7/1989 | Kessler, Jr. | 148/516 |
| 4,998,581 A | | 3/1991 | Lane et al. | 164/517 |
| 5,273,104 A | | 12/1993 | Renaud et al. | |
| 5,297,615 A | | 3/1994 | Aimone et al. | |
| RE34,702 E | * | 8/1994 | Lane et al. | 164/517 |

FOREIGN PATENT DOCUMENTS

| | | | | |
|---|---|---|---|---|
| EP | 0763 392 A2 | | 3/1997 | |
| FR | 1384290 | | 12/1965 | |
| GB | 1031587 | | 6/1966 | |
| JP | 55064945 | | 5/1980 | |
| JP | 56017157 | | 2/1981 | |
| JP | 0 206 548 | | 12/1982 | 164/411 |
| JP | 57-206548 | * | 12/1982 | |
| JP | 57206548 | | 12/1982 | |
| JP | 0 202 744 | | 9/1986 | 164/519 |
| JP | 61-202744 | * | 9/1986 | |
| JP | 02 322 035 | | 10/1986 | 164/411 |
| JP | 6475139 | | 3/1989 | |
| JP | 404 123 840 | | 4/1992 | 164/519 |

* cited by examiner

*Primary Examiner*—Kuang Y. Lin

(57) ABSTRACT

A ceramic investment shell mold is reinforced with a carbon based fibrous reinforcement having an extremely high tensile strength that increases as the mold temperature is increased especially within the range of casting temperatures employed for casting large directionally solidified industrial gas turbine components. The carbon based fibrous reinforcement is wrapped or otherwise positioned around the repeating ceramic slurry/stucco layers forming the intermediate thickness of the shell mold wall. The reinforced shell mold can be used to cast large directionally solidified industrial gas turbine components with accurate dimensional control.

10 Claims, 3 Drawing Sheets

REINFORCED CERAMIC SHELL MOLD AND METHOD OF MAKING SAME

This is a division of Ser. No. 08/935,846 filed Sep. 23, 1997, now U.S. Pat. No. 6,364,000.

FIELD OF THE INVENTION

The present invention relates to a reinforced ceramic investment casting shell mold especially useful in the casting of large industrial gas turbine and aerospace components and a method of making same such that the shell mold exhibits increased strength and creep resistance at elevated casting temperatures to maintain casting dimensional control.

BACKGROUND OF THE INVENTION

Ceramic investment shell molds are widely used in the investment casting of superalloys and other metals/alloys to produce gas turbine engine components, such as turbine blades, and aerospace components, such as structural airframe components, to near net shape where dimensional control of the casting is provided by the shell mold cavity dimensions.

The need for industrial gas turbines (IGT's) with improved operating performance has increased the demand for large IGT components with directionally solidified (DS) microstructures, such as columnar grain and single crystal cast microstructures. However, production of DS components subjects the ceramic investment shell mold to casting parameters, such as elevated temperature, metallostatic pressure and time, beyond the capability of present ceramic investment shell molds. In particular, present ceramic investment shell molds are susceptible to bulging and cracking during DS casting processes, especially when the shell mold is filled with a large quantity of molten metal/alloy at higher casting temperature and longer times needed, for example, to effect directional soldification of the IGT components.

When the investment shell mold bulges or sags during the DS casting process, dimensional control is lost and inaccurately dimensioned cast components are produced. Moreover, a significant cracking of the shell mold can occur and result in runout of molten metal/alloy and a scrap casting.

The most common ceramic mold materials, such as alumina and zirconia, used to produce ceramic shell molds exhibit creep deformation at about 2700 degrees F. with the creep deformation increasing with increasing temperature and hold time at temperature. Hold times in excess of 3 hours and temperature in excess of 2800 degrees F. are common in the casting of large directionally solidified IGT components. These casting parameters together with increased metallostatic pressure involved are severe enough that conventional ceramic shell molds have not been suitable for the casting of large directionally solidified IGT components. In particular, use of conventional ceramic shell molds for the casting of large directionally solidified IGT blades has resulted in changes in the blade chord width or changes to blade bow and displacment indicative of mold bulging or sagging during DS casting.

Therefore, there is an acute need for more robust ceramic shell molds that can withstand these severe casting parameters and resist creep deformation, such as bulging and sagging, as well as cracking to enable casting of large directionally solidified IGT components with dimensional control.

Several attempts have been investigated to raise the capability of ceramic shell molds manufactured using conventional ceramic materials. For example, one attempt has involved use of composite shell molds made of combinations of ceramic materials to minmize grain growth and hence reduce creep deformation of the mold. U.S. Reissue No. 34,702 describes another attempt wherein alumina-based or mullite-based ceramic fibrous reinforcement is wrapped about the mold. These techniques, although having further pushed the limit of conventional shell molds, have been found not to be sufficient to meet the stringent casting parameters imposed in the casting of large directionally solidified IGT components with dimensional control.

An object of the present invention is to provide a ceramic investment shell mold reinforced in a manner to exhibit improved resistance to creep deformation and cracking at elevated casting temperatures, especially under the aforementioned severe casting parameters demanded by casting of large directionally solidified IGT components with dimensional control.

Another object of the present invention is to provide a method of making a ceramic investment shell mold reinforced in a manner to exhibit improved resistance to creep deformation and cracking at elevated casting temperatures.

Still another object of the present invention is to provide a method of casting large directionally solidified IGT components with dimensional control.

SUMMARY OF THE INVENTION

To achieve the foregoing objects and in accordance with the purpose of the invention, as embodied and broadly described herein, a ceramic investment shell mold is reinforced with a carbon based fibrous reinforcement having an extremely high tensile strength sufficient to reduce creep deformation of the mold, such as bulging or sagging, at high casting temperature, especially at temperatures experienced during casting of large directionally solidified IGT components. Preferably, the carbon based fibrous reinforcement is made of carbon fibers or filaments having a tensile strength of at least about 250,000 psi at room temperature (70 degrees F.) and a coefficient of thermal expansion that is less than the average coefficient of thermal expansion of shell mold to provide compressive loading of the mold.

Carbon fiber cordage (comprising a large number of carbon fibers or filaments) having a cordage breaking strength of 90 to 165 pound force, preferably 120 to 165 pound force, at room temperature is especially preferred as the reinforcement.

The carbon based fibrous reinforcement preferably is disposed at the ceramic slurry/stucco layers forming the intermdiate thickness of the shell mold wall. For example only, the carbon based fibrous reinforcement can be disposed around the 6th to the 9th shell mold layers forming an intermediate thickness of the shell mold wall.

In a method embodiment of the present invention, a pattern having the desired shape of the cast component to be produced is dipped in ceramic slurry and then stuccoed with relatively coarse ceramic stucco with the sequence repeated to build up a shell mold wall comprising repeating ceramic slurry/stucco layers on the pattern. At intermediate ceramic slurry/stucco layers defining an intermediate shell mold wall thickness, the carbon based fibrous reinforcement is applied around the shell mold wall, preferably by wrapping in a sprial configuration about the intermediate shell mold wall, followed by continuation of the dipping and stuccoing steps to build up the overall shell mold wall thickness over the reinforcement. When used, the sprial wrapped carbon based fibrous reinforcement can have a space between successive wraps of about 0.2 to 1 inch.

A carbon based woven or braided fiber cloth like reinforcement can be used to reinforce regions of the shell mold which render difficult or prohibit wrapping of the reinforement around the shell mold.

A method of casting large directionally solidified IGT components with dimensional control in accordance with an embodiment of the present invention involves preheating a ceramic investment shell mold reinforced as decribed above to an elevated casting temperature above about 2800 degrees F., introducing molten metal into the preheated shell mold, and directionally solidifying the molten metal residing in the shell mold by propagating a solidification front through the molten metal over an extended time period to form a columnar grain or single crystal microstructure. Large IGT components typically involve introduction of molten metal in the range of about 40 to about 300 pounds molten metal into the preheated shell mold and solidified over a time period of about 3 to about 6 hours therein.

The above objects and advantages of the present invention will be better understood with reference to the following drawings taken with the following detailed description.

DETAILED DESCRIPTION OF THE INVENTION

Figure 1:
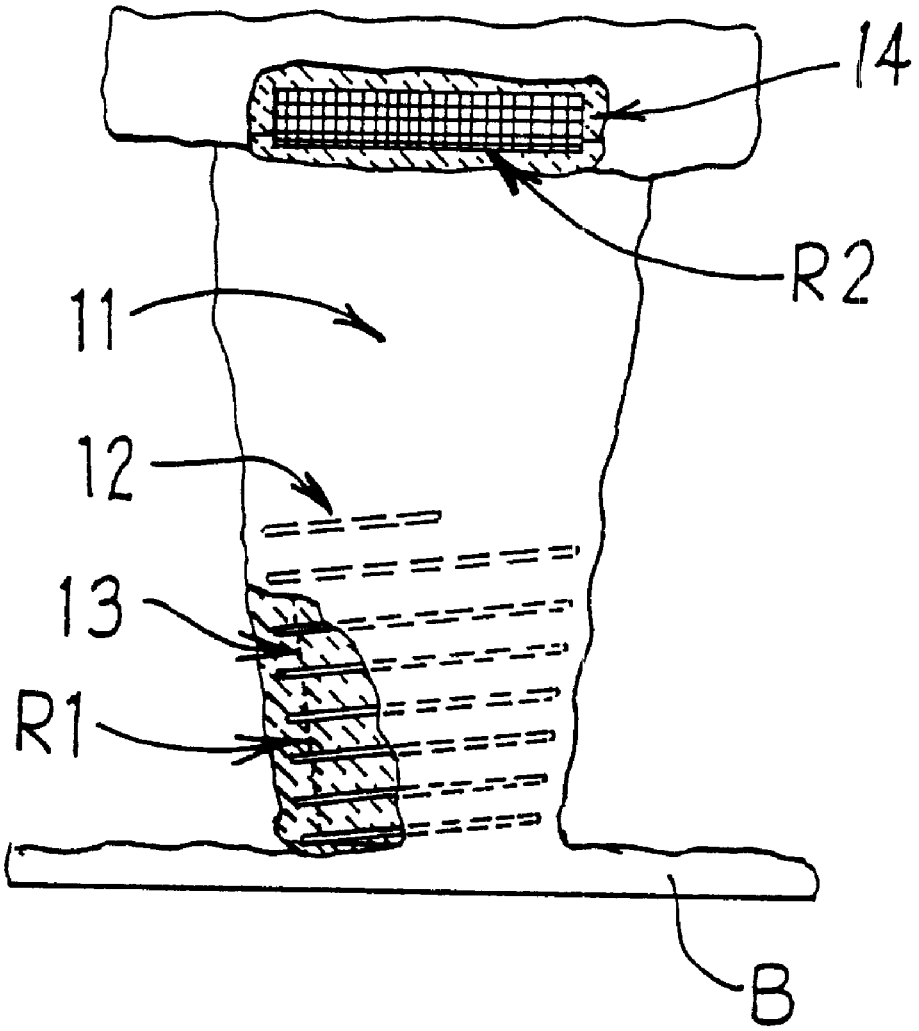
FIG. 1 is schematic side elevational view, partially broken way, of a ceramic investment mold in accordance with an embodiment of the invention reinforced with a carbon based fiber reinforcement cordage wrapped thereon.

Reference will now be made in detail to an illustrative embodiment of the present invention especially useful for the casting of large directionally solidified IGT components with accurate dimensional control, although the present invention can be practiced cast other myriad components using casting techniques other than directional solidification.

A fugitive pattern having the shape of the desired cast component to be made is provided. The pattern may be made of wax, plastic, foam or other suitable pattern material for use in the so-called "lost wax" process. The "lost wax" process is well known and involves dipping the pattern into a ceramic slurry comprising cermaic powders or flour in a binder to form a slurry layer on the pattern, draining excess slurry, and then applying a stucco layer of relatively coarse dry, ceramic stucco particles (e.g. 120 mesh or coarser alumina particles). After drying the slurry/stucco layers, the dipping/draining/stuccoing sequence is repeated to build up the desired shell mold wall thickness. The initial slurry coating or layer applied to the pattern forms a so-called facecoat that contacts the molten metal and comprises a highly refractory ceramic material and a binder. To this end, the ceramic slurry may be comprised of silcia, alumina, zirconia or other suitable ceramic powders or flours in a suitable binder (e.g. colloidal silica), depending upon the metal to be cast in the shell mold.

In practicing an illustrative embodiment of the invention, the dipping/stuccoing steps typically are repeated over the facecoat to build up an intermediate thickness of the shell mold wall that is less the final overall mold wall thickness. The intermediate wall thickness used can be varied depending upon the final mold wall thickness desired. Typically, the intermediate shell mold thickness can be built up by repeating the dipping step and stuccoing step 6 to 9 times. Any sharp edges and corners formed on the shell mold are rounded at the intermediate stage of the shell build up.

In accordance with an embodiment of the invention, a carbon based fibrous reinforcement 12 is disposed around the intermediate shell mold thickness of the shell mold at a region requiring reinforcement. For example, in FIG. 1, the reinforcement 12 is disposed around the intermediate shell mold thickness at an airfoil tip region R1 of the mold 11 for making a large industrial gas turbine blade. The airfoil tip region of the shell mold 11 is connected to a mold base B that in turn rests on a chill plate (not shown) of DS casting apparatus as is well known. The reinforcement 12 can be disposed around the entire shell mold or a region thereof requiring reinforcement. The carbon based fibrous reinforcement has an extremely high tensile strength that increases with mold temperature in the range of DS casting temperatures where conventional ceramic materials are weak and further has a coefficient of thermal expansion that is less than the average coefficient of thermal expansion of shell mold to provide compressive loading of the mold wall at casting temperature. The average coefficient of thermal expansion of shell mold is based on the coefficients of thermal expansion of the ceramic materials comprising the ceramic slurry powders and the ceramic stucco.

The carbon based fibrous reinforcement 12 preferably comprises a pan-based material from polyacrylonitrile, rather than a pitch-based material from tar-based material. To this end, the reinforcement 12 preferably comprises pan-based carbon fibers or filaments having a tensile strength of at least about 250,000 psi at room temperature and a coefficient of thermal expansion at 2700 degrees F. that is about ¼ the average coefficient of thermal expansion of the shell mold. Such carbon fibers and filaments are available commercially form Amoco Coporation, Greenville, S.C., and Hecules Corporation, Wilmington, Del. The carbon based fibrous reinforcement typically will have a continuous length sufficient to be wound or wrapped around the intermediate shell mold wall thickness as needed, for example, as illustrated in FIG. 1 for an IGT airfoil.

A preferred elongated carbon based fibrous reinforcement comprises carbon fiber cordage having a cordage breaking strength of 90 to 165 pound force, preferably 120 to 165 pound force. Such carbon fiber cordage typically comprises from 12,000 to 24,000 braided fibers or filaments forming the cordage. Twisted fiber cordage is advantageous in terms of convenience of handling and winding around the intermediate mold wall thickness. The fibers or filaments typically will have individual diameters in the range of 10 microns to 20 microns.

The breaking strength of the carbon fiber cordage will depend on its overall diameter which, in turn, depends on the number of carbon fibers or filaments in the cordage as well as individual fiber diameters. A representative breaking strength of a carbon fiber cordage having a diameter of 0.034 inch and containing 12,000 filaments of 12 microns diameter is about 90 pound-force, whereas that for a 0.072 inch diameter cordage containing 24,000 filaments of the same diameter is about 165 pound-force. Carbon fiber cordage of this type is available commercially from Fiber Materials Inc., Biddeford, Me.

Figure 2:
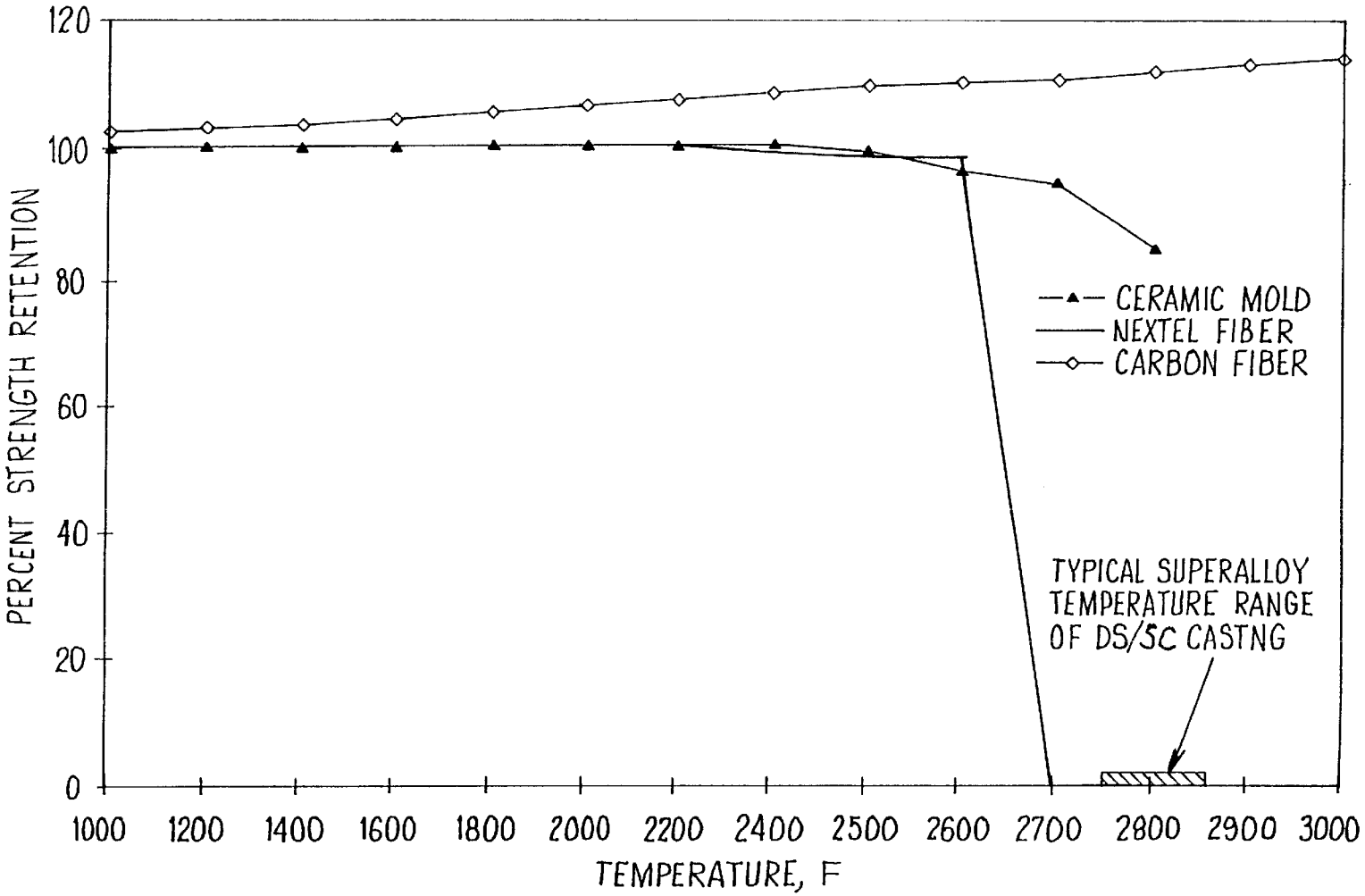
FIG. 2 is a graph showing the percent strength retention of ceramic mold, Nextel 440 fiber, and carbon fiber as temperature increases.

FIG. 2 illustrates the percent retention of room temperature tensile strength at elevated temperatures for a carbon reinforcing fiber of the polyacrylonitrile type useful in practicing the invention, Nextel 440 mullite based ceramic fibers, and ceramic (alumina-based slurry/stucco layers) shell mold material.

Unlike the other materials shown in FIG. 2, the carbon reinforcing fiber does not lose its tensile strength with increasing temperatures in the range of typical casting temperature 2750 to 2850 degrees F. for DS casting processes. The carbon reinforcing fiber increases in tensile strength with increasing temperature in the DS casting tempreature range of 2750 to 2850 degrees F. and, more generally, from 2500 up to 4000 degrees F.

Although a Nextel 440 reinforced shell mold pursuant to U.S. Reissue No. 34,702 functions relatively well up to temperatures of 2750 degrees F. as long as hold time is short (e.g. 2 hours) and the metallostatic pressure is low, an increase in casting temperature beyond 2800 degrees F. results in the Nextel 440 fiber reinforced shell mold exhibiting creep deformation because of the softening of the Nextel fibers illustrated in FIG. 2.

A carbon fibrous reinforced shell mold pursuant of the present invention will reduce or avoid such creep as a result of the increasing tensile strength and creep resistance of the carbon fibers with temperature illustrated in FIG. 2. Such increased tensile strength and creep resistance of the shell mold is needed for the large ceramic shell molds used for casting large directionally solidified IGT components with dimensional accuracy.

The reinforcement 12 is disposed around the intermediate shell mold thickness with sufficient tension that it remains fixed during subsequent handling, dipping and stuccoing required to build up the shell mold to its overall thickness. If desired, ceramic adhesive or dip coat may be used to locally fasten the free ends and intermediate sections of the fibrous reinforcement to the shell mold for convenience in handling.

The reinforcement 12 typically is wrapped in a substantially continuous sprial configuration around the intermediate thickness of the shell mold with a space 13 between successive wraps or spirals. The space between successive sprial wraps is provided to allow for adequate shell build up around the reinforcement 12 to structurally join the reinforcement to the shell mold. The space between successive spiral wraps of the reinforcement 12 can be about 0.2 to 1 inch to this end for carbon fiber reinforcement 12.

After the reinforcement 12 is disposed around the intermediate mold wall thickness, the remaining ceramic slurry and stucco layers are applied to build up the mold wall W to the final overall thickness desired. The green shell mold then is dried, subjected to a pattern removal operation, such as conventional dewaxing operation for a wax pattern, and conventionally fired at elevated temperature (e.g. 1800 degrees F.) to develop adequate mold strength for casting.

Altenately, a carbon based fiber loosely woven or braided fiber fabric or cloth 14 can be used to locally reinforce regions of the shell mold which are not amenable to spiral wrapping of the reinforcement 12. For example, in FIG. 1, a loosely woven or braided carbon fiber cloth 14 is positioned around a region R2 of the intermediate mold wall thickness defining a platform of the shell mold 11 for making a large industrial gas turbine blade.

Figure 3:
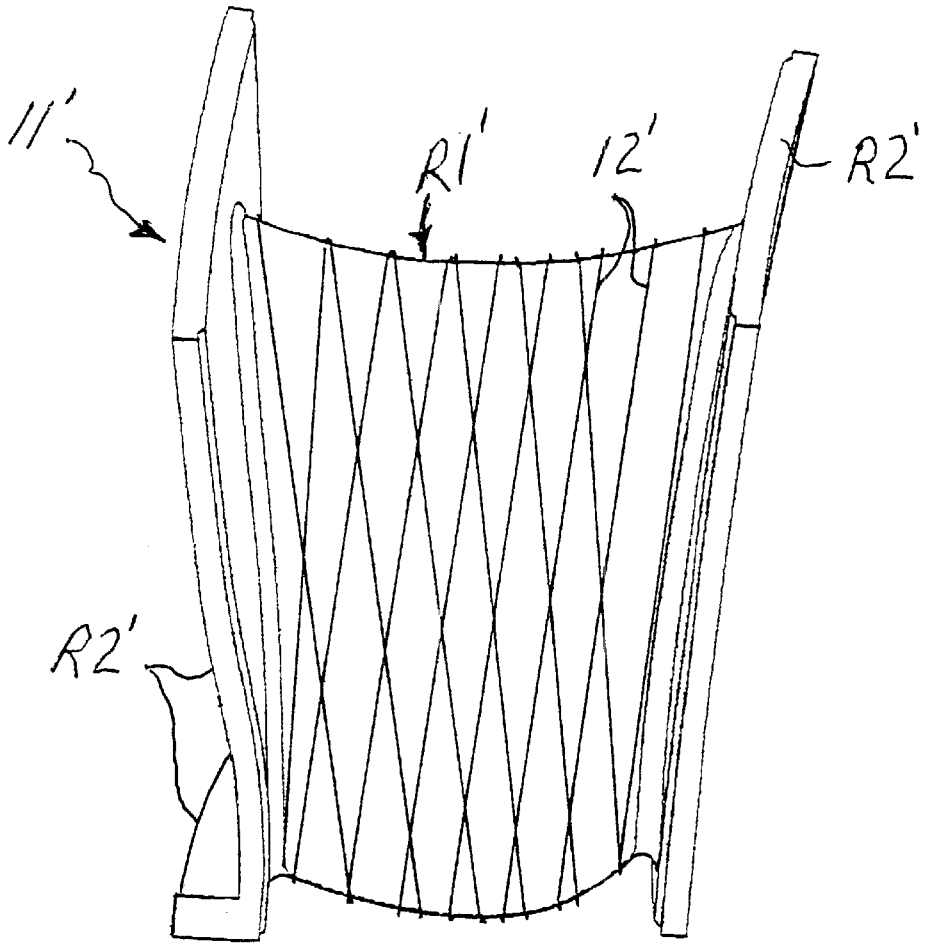
FIG. 3 is a perspective view of a ceramic investment mold in accordance with another embodiment of the invention reinforced with a carbon based fiber reinforcement cordage wrapped thereon.

In lieu of the sprial wrap described above, the reinforcement can be applied about the mold in other patterns, for example only, as shown in FIG. 3 where the reinforcement 12' is criss-crossed about an airfoil region R1' of a mold having enlarged platform type end regions R2'.

The invention can be practiced to provide virtually any reinforced ceramic investment shell mold, and is especially useful and advantageous for reinforced ceramic investment shell molds for casting large directionally solidified IGT components (e.g. about 40 to about 300 pounds per casting) with accurate dimensional control as a result of the reduction, or elimination, of creep deformation, such as mold bulging or sagging, under DS solidification processing conditions. DS solidification processing can be effected by the well known mold withdrawal technique where the shell mold residing on chill plate in a casting furnace is preheated to a selected elevated casting temperature, melt is introduced into the preheated mold, and the melt-filled mold residing on the chill plate is gradually withdrawn from a casting furnace over an extended time period to form a columnar grain or single crystal microstructure in the casting. The well known power down technique as well as other DS casting techniques that establish undirectional heat removal from the molten metal in the shell mold also may be used.

As a result of the carbon fibrous reinforcement having a coefficent of thermal expansion less than the average coefficient of thermal expansion of the ceramic materials comprising the shell mold, the reinforcement 12 imparts a compressive load on the regions of the shell mold on which it is disposed. This compressive load serves to increase the green (unfired) strength, fired strength, and hot casting strength of the shell mold. The compressive load exerted by the reinforcement increases with increasing temperature and helps in minimizing the growth and expansion of any cracks that may have formed by prior dewaxing operations.

The following Examples are offered for purposes of illustrating the invention and not limiting it.

EXAMPLE 1

A 16 inch long and 10 inch wide single crystal shell mold was spirally wound with carbon cordage reinforcement at the 7th slurry dip coat or layer. The mold cavity was shaped to make a gas turbine vane. The carbon cordage was available from Fiber Materials, Inc. and had a diameter of 0.075 inch and 24,000 carbon filaments of individual filament diameter of 12 microns. A total of 7 turns of the cordage were made around the shell mold intermediate wall thickness in spiral fashion as illustrated in FIG. 1 with a space between successive spiral wraps of ½ inch. After the reinforcement was wrapped, the shell mold was further dipped and stuccoed to apply 7 additional layers to bring the shell mold wall thickness to a final wall thickness of ½ inch. The ceramic slurry for the dip coats comprised alumina slurry, while the ceramic stucco comprised alumina stucco.

A total of 5 such shell molds were made. Each mold was preheated to 2800 degrees F. and cast with 45 pounds of N5 nickel base superalloy, at a melt temperature of 2820 degrees F. followed by directional soildification using the well known mold withdrawal technique for a period of 4 hours to propagate a soldification front through the molten alloy and form a single crystal casting in the shell molds. The shell molds held the molten metal and produced dimensionally acceptable castings.

EXAMPLE 2

A 20 inch long and 6 inch wide IGT blade shell mold was spirally wound with carbon cordage reinforcement at the 8th dip slurry coat or layer. The carbon cordage was available from Fiber Materials, Inc. and had a dimaeter of 0.075 inch and 24,000 carbon filaments of individual filament diameter of 12 microns. A total of 8 turns of the cordage were made around the shell mold intermdiate wall in spiral fashion as illustrated in FIG. 1 with a space between successive spiral wraps of ⅝ inch. After the reinforcement was wrapped, the shell mold was further dipped and stuccoed to apply 7 additional layers to bring the shell mold wall thickness to a final wall thickness of ½ inch. The ceramic slurry for the dip coats comprised alumina slurry, while the ceramic stucco comprised alumina stucco.

The shell mold was preheated to 2750 degrees F. and cast with 40 pounds of GTD 111 nickel base superalloy at a melt temperature of 2750 degrees F. followed by directional solidification using the well known mold withdrawal technique for 4 hours to propagate a soldification front through the molten alloy and form a single crystal casting. The shell mold held the molten metal without mold leakage. The blade casting was dimensionally evaluated and found to be acceptable to blue print specifications and showed no increase in the blade chord width or changes to blade bow and displacment, indicating the absence of mold bulging or sagging.

Although the present invention has been described in terms of illustrative embodiments thereof, it is not intended to be limited thereto but rather only as set forth in the appended claims.

We claim:

1. A ceramic investment shell mold having a mold wall reinforced with a carbon based fibrous reinforcement having sufficent tensile strength at casting temperature to reduce creep deformation of the shell mold and having a coefficient of thermal expansion that is less than the average coefficient of thermal expansion of shell mold to provide compressive loading at casting temperature.

2. The mold of claim 1 wherein the carbon based fibrous reinforcement is comprised of a plurality of carbon fibers or filaments having a tensile strength of at least about 250,000 psi at room temperature.

3. The mold of claim 2 wherein the carbon fibers or filaments have a coefficient of thermal expansion that is about ¼ the average coefficient of thermal expansion of the shell mold at room temperature.

4. The mold of claim 1 wherein the carbon based fibrous reinforcement comprises carbon fiber cordage having a cordage breaking strength of about 90 to about 165 pound force.

5. The mold of claim 4 wherein the carbon fiber cordage comprises woven carbon fiber yarn.

6. The mold of claim 1 wherein the carbon based fibrous reinforcement comprises woven or braided carbon fiber net-like cloth.

7. The mold of claim 1 wherein the carbon based fibrous reinforcement is disposed at the repeating ceramic slurry/stucco layers forming the intermediate thickness of the shell mold wall.

8. The mold of claim 1 wherein the carbon based fibrous reinforcement is disposed around the 6th to the 9th shell mold layers forming an intermediate thickness of the shell mold wall.

9. The mold of claim 1 wherein the carbon based fibrous reinforcement is wrapped in a sprial configuration around the shell mold with a space between successive wraps.

10. The mold of claim 9 wherein the sprial carbon based fibrous reinforcement has a space between successive wraps of said reinforcement of about 0.2 to 1 inch.

* * * * *

UNITED STATES PATENT AND TRADEMARK OFFICE

CERTIFICATE OF CORRECTION

PATENT NO. : 6,568,458 B2
DATED : May 27, 2003
INVENTOR(S) : Rajeev V. Naik et al.

It is certified that error appears in the above-identified patent and that said Letters Patent is hereby corrected as shown below:

Column 7,
Line 29, after "with" insert -- a continuous length of --.
Line 30, after "at" insert -- elevated --.
Line 30, after "temperature" insert -- of about 2750 degrees F and above --.
Line 32, delete "creep".
Line 34, after "at" insert -- the --.

Column 8,
Line 20, replace "at" with -- between --.
Lines 28 and 30, replace "sprial" with -- spiral --.

Signed and Sealed this

Sixteenth Day of September, 2003

JAMES E. ROGAN
*Director of the United States Patent and Trademark Office*